US007591274B2

(12) United States Patent
Lin et al.

(10) Patent No.: US 7,591,274 B2
(45) Date of Patent: Sep. 22, 2009

(54) ECONOMICALLY CONSTRUCTED AND ENVIRONMENTALLY PROTECTIVE UMBRELLA FORMED WITH ONE-PIECE FRAME

(75) Inventors: Chung-Kuang Lin, Taipei Hsien (TW); Jung-Jen Chang, Taipei Hsien (TW)

(73) Assignee: Fu Tai Umbrealla Works, Ltd., Taipei Hsien (TW)

( * ) Notice: Subject to any disclaimer, the term of this patent is extended or adjusted under 35 U.S.C. 154(b) by 188 days.

(21) Appl. No.: 11/526,081

(22) Filed: Sep. 25, 2006

(65) Prior Publication Data

US 2008/0072939 A1 Mar. 27, 2008

(51) Int. Cl.
*A45B 23/00* (2006.01)
*A45B 25/02* (2006.01)

(52) U.S. Cl. ..... 135/15.1; 135/28; 135/31; 135/19.5

(58) Field of Classification Search ..... 135/15.1, 135/19.5, 25.34, 28–29, 31–32, 38, 41; 211/197
See application file for complete search history.

(56) References Cited

U.S. PATENT DOCUMENTS 1,045,595 A * 11/1912 Nygren ..... 135/25.3
2,296,666 A * 9/1942 Haupt ..... 135/26
3,177,883 A * 4/1965 Militano ..... 135/15.1
3,252,468 A * 5/1966 Militano ..... 135/28
3,693,643 A * 9/1972 Weber ..... 135/26
4,624,275 A * 11/1986 Baldwin ..... 135/19.5
4,821,756 A * 4/1989 England ..... 135/19.5
6,173,723 B1 * 1/2001 Wang ..... 135/31
6,237,615 B1 * 5/2001 Carso et al. ..... 135/19.5
7,401,616 B2 * 7/2008 Wang ..... 135/28
2003/0221714 A1 * 12/2003 Wang ..... 135/33.6

FOREIGN PATENT DOCUMENTS

GB 2267640 A * 12/1993

* cited by examiner

*Primary Examiner*—Winnie Yip
(74) *Attorney, Agent, or Firm*—Troxell Law Office PLLC

(57) ABSTRACT

An umbrella comprises: a central shaft having an upper hub formed on a top portion of the central shaft; an one-piece frame having a plurality of rib assemblies integrally formed with an upper ferrule and a lower ferrule, with the upper ferrule secured to the upper hub and with the lower ferrule formed with a lower runner slidably held on the central shaft; and an umbrella cloth or cover secured on the frame; thereby forming an umbrella which can be easily constructed for use; and can also be easily detached, when damaged, for reclaiming the parts or elements in construction of the umbrella for environmental protection purpose.

1 Claim, 7 Drawing Sheets

ECONOMICALLY CONSTRUCTED AND ENVIRONMENTALLY PROTECTIVE UMBRELLA FORMED WITH ONE-PIECE FRAME

BACKGROUND OF THE INVENTION

U.S. Pat. No. 4,821,756 (hereinafter called "Prior Art") disclosed a collapsible disposable umbrella formed with plastic, polyethylene, etc.

Reviewing the prior art (FIGS. 14 and 17), the rib assembly (80) consisting of rib (26) and strut (32) is cast as a single unit. Each rib assembly (80) includes an upper hook (84) inserted into an upper hub member (38) and a lower hook (94) inserted into a lower hub member (34). So, a plurality of rib assemblies (80) should be provided for assembling the umbrella. Each rib assembly (80) requires a processing work for inserting the hooks (84, 94) into the hub members (38, 34), thereby increasing the assembly procedures and increasing the production cost when forming the umbrella.

The present inventor has found the drawbacks of the prior art, and invented the present environmentally protective umbrella as economically constructed.

SUMMARY OF THE INVENTION

The object of the present invention is to provide an umbrella comprising: a central shaft having an upper hub formed on a top portion of the central shaft; an one-piece frame having a plurality of rib assemblies integrally formed with an upper ferrule and a lower ferrule, with the upper ferrule secured to the upper hub and with the lower ferrule formed with a lower runner slidably held on the central shaft; and an umbrella cloth or cover secured on the frame; thereby forming an umbrella which can be easily constructed for use; and can also be easily detached, when damaged, for reclaiming the parts or elements in construction of the umbrella for environmental protection purpose.

DETAILED DESCRIPTION

Figure 1:
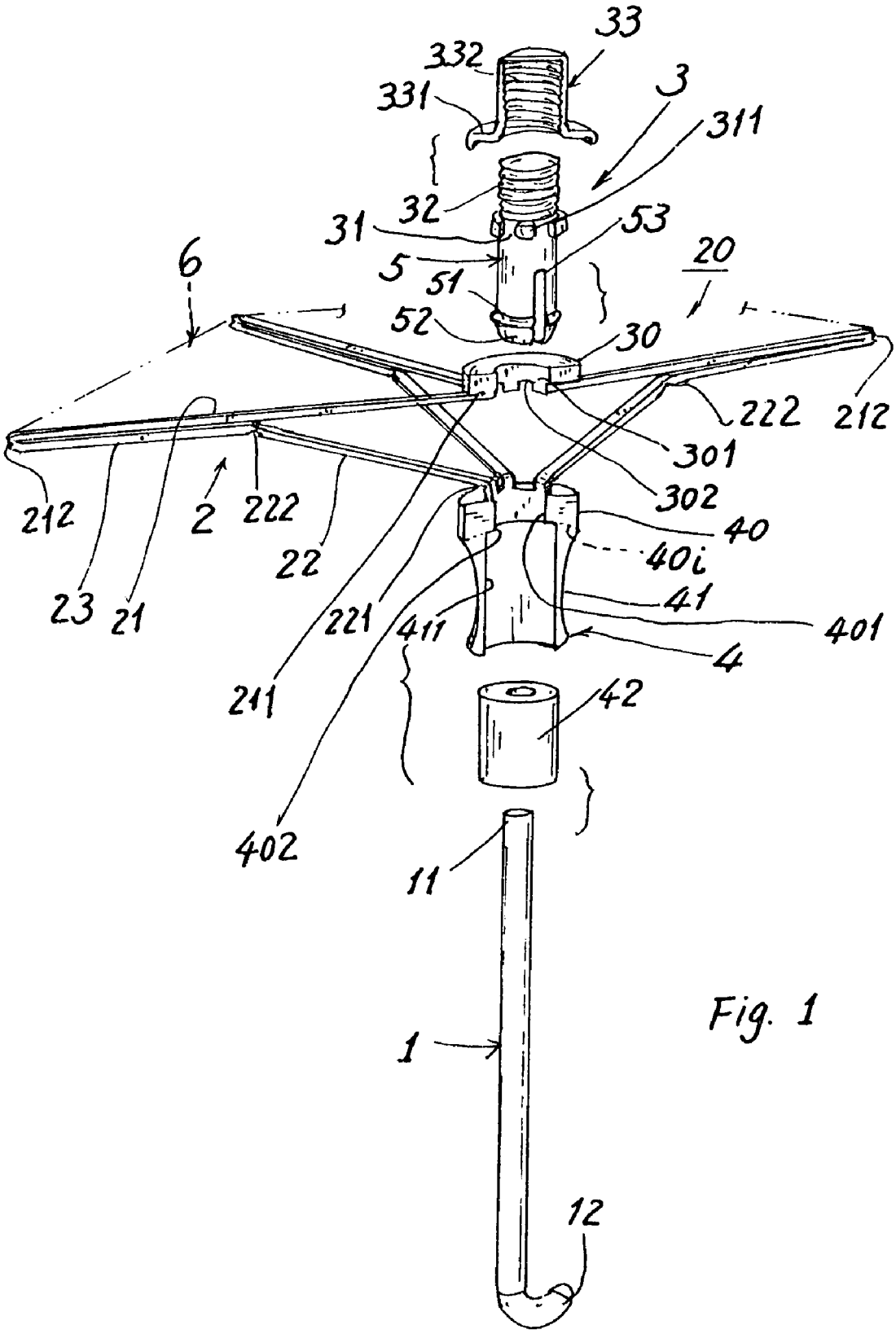
FIG. 1 is a perspective view showing the elements of the present invention.

As shown in FIGS. 1-5, the umbrella of the present invention comprises: a central shaft 1; an one-piece frame 20 consisting of a plurality of rib assemblies 2; an upper hub 3 secured or formed on a top portion 11 of the central shaft 1; a lower runner 4 slidably held on the central shaft 1; a catch means 5 formed on the upper hub 3 or on the shaft 1; and an umbrella cloth (or cover or canopy) 6 secured on the frame 20.

All the elements or the parts of the present invention may be made of plastic materials or other suitable materials.

The central shaft 1 has its lower portion formed as a grip or handle 12. The grip 12 may be integrally formed with or detachably assembled to the shaft 1.

The one-piece frame 20 is integrally formed by plastic molding processes to have a plurality of rib assemblies 2 integrally formed with an upper ferrule 30 of the upper hub 3 and also integrally formed with a lower ferrule 40 of the lower runner 4.

Each rib assembly 2 is integrally formed and includes: a top rib 21 integrally secured to the upper ferrule 30 of the upper hub 3, a stretcher rib 22 integrally secured to the lower ferrule 40 of the lower runner 4, and an intermediate rib 23 integrally connected between the top rib 21 and the stretcher rib 22.

The top rib 21 has an inner end portion of the top rib 21 formed as an inner notched portion 211 between the top rib 21 and the upper ferrule 30 to serve as an inner pival portion or inner living hinge 211 of the top rib 21 to be pivotally secured to the upper ferrule 30, and an outer end portion of the top rib 21 formed as an outer notched portion 212 between the top rib 21 and the intermediate rib 23 to be an outer pivotal portion or outer living hinge 212 between the top rib 21 and the intermediate rib 23; with the intermediate rib 23 bending inwardly about the outer notched portion 212 and juxtapositioned beneath the top rib 21 to reinforcedly support the top rib 21.

The stretcher rib 22 has an inner end portion of the stretcher rib 22 formed as a lower inner notched portion 221 between the lower ferrule 40 and the stretcher rib 22 to serve as a lower inner pivotal portion or lower inner living hinge 221 of the stretcher rib 22 to be pivotally secured to the lower ferrule 40, and a lower outer end portion of the stretcher rib 22 formed as a lower outer notched portion 222 between the stretcher rib 22 and the intermediate rib 23 to be a lower outer living hinge 222 between the stretcher rib 22 and the intermediate rib 23 for pivotally connecting the stretcher rib 22 with the intermediate rib 23.

The umbrella cloth (or cover) 6 has its inner cloth portion 60 secured to the upper hub 3, a middle cloth portion 61 secured to the lower outer living hinge 222 between the stretcher rib 22 and the intermediate rib 23 by threads or other fasteners, and an outer cloth portion 62 secured to the outer living hinge 212 by threads or other fasteners.

The upper hub 3 includes: a plug member 31 secured to a top portion 11 of the central shaft 1; an upper ferrule 30 integrally formed with the top ribs 21 of the frame 20, and engaged with the plug member 31, having a male-threaded portion 32 formed on an upper portion of the plug member 31; and a cap 33 having a female-threaded portion 332 formed in the cap 33 to be engaged with the male-threaded portion 32 of the plug member 31 and having a flange 331 circumferentially formed on a perimeter of the cap 33 for covering the upper ferrule 30 when engaged with and secured on the plug member 31.

Figures 2, 3:
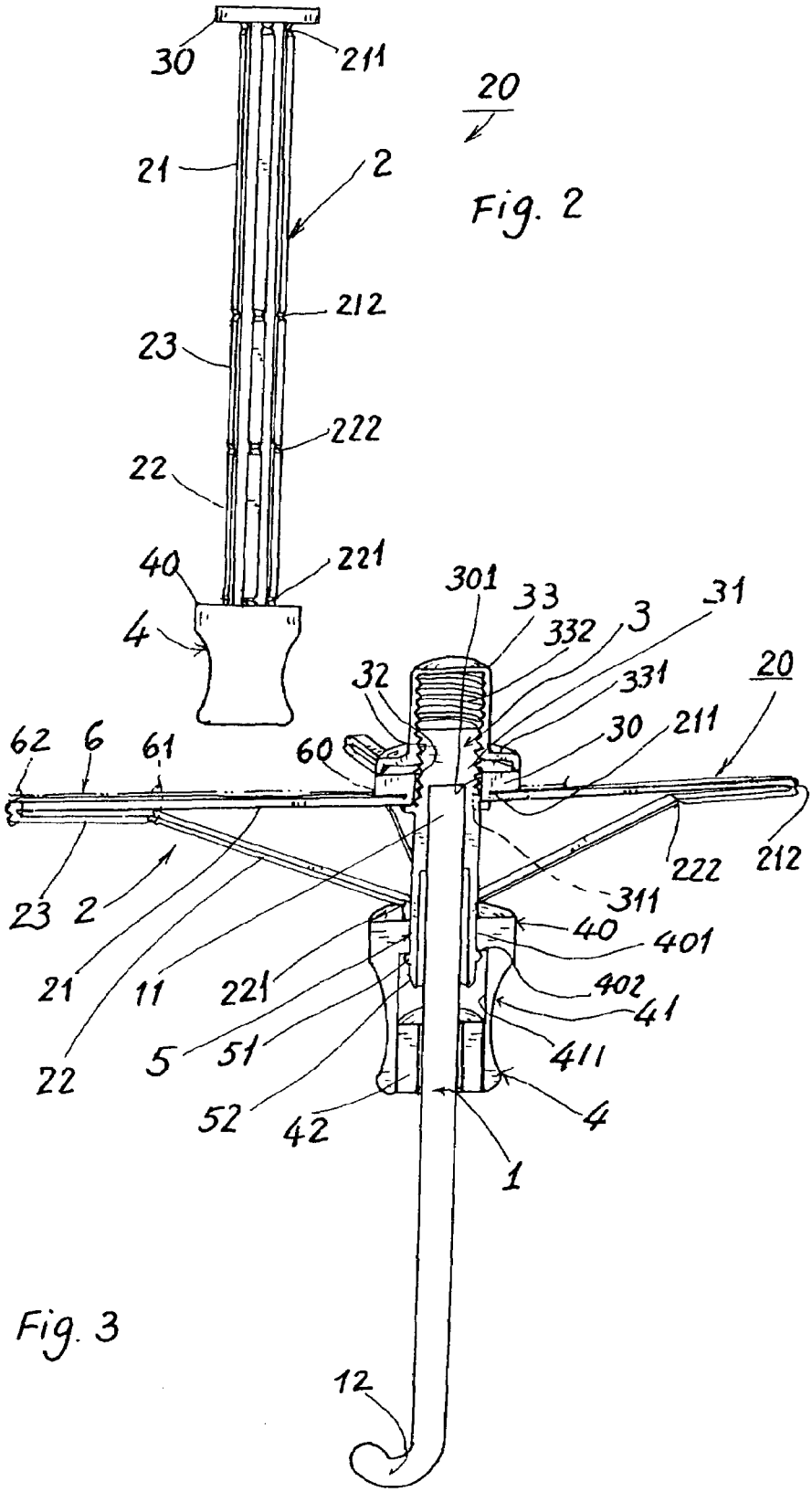
FIG. 2 shows the one-piece frame of the present invention.
FIG. 3 is a partially cut-away illustration of the present invention when assembled.

The upper ferrule 30 includes a central hole 301 for passing the male-threaded portion 32 therethrough and a plurality of recesses 302 formed in an annular bottom portion of the upper ferrule 30 to be engaged with a plurality of projections 311 circumferentially formed on the plug member 31 to secure the upper ferrule 30 on the plug member 31 of the upper hub 3, whereby upon protruding of the male-threaded portion 32 of the plug member 31 through the central hole 301 of the upper ferrule 30 and upon engagement of the cap 33 on the male-threaded portion 32, the upper ferrule 30 will be firmly retained on the upper hub 3 and on the top portion of the central shaft 1 (FIG. 3).

Figure 4:
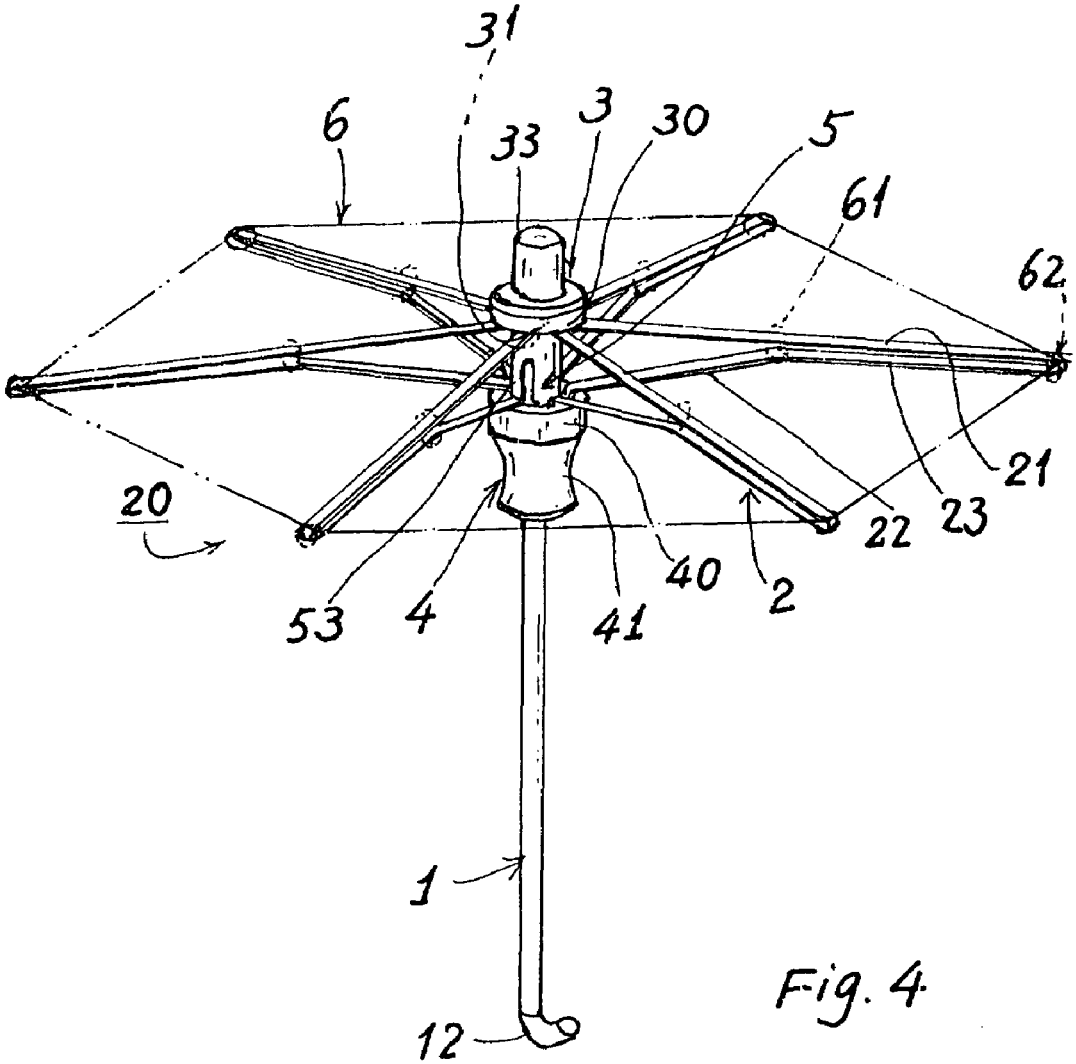
FIG. 4 is an illustration showing an opening umbrella of the present invention.

The lower runner 4 includes a slide member 41 defining a cylindrical hole 411 in the slide member 41; a lower ferrule 40 integrally formed with the stretcher ribs 22 of the frame 20 and integrally formed or formed on an upper portion of the slide member 41, having a lower ferrule hole 401 formed through the lower ferrule 40 and communicated with the cylindrical hole 411 to be slidably movable on the central shaft 1; and a shoulder portion 402 formed in between the lower ferrule hole 401 and the cylindrical hole 411 to be engaged with the catch means 5 when opening the umbrella (FIGS. 3 and 4).

If the slide member 41 is not integrally formed with the lower ferrule 40 as aforementioned, the lower ferrule 40 may be formed or secured to the slide member 41 along an interface 40*i* as shown in dotted line of FIG. 1 by mechanical or chemical joining.

Figure 5:
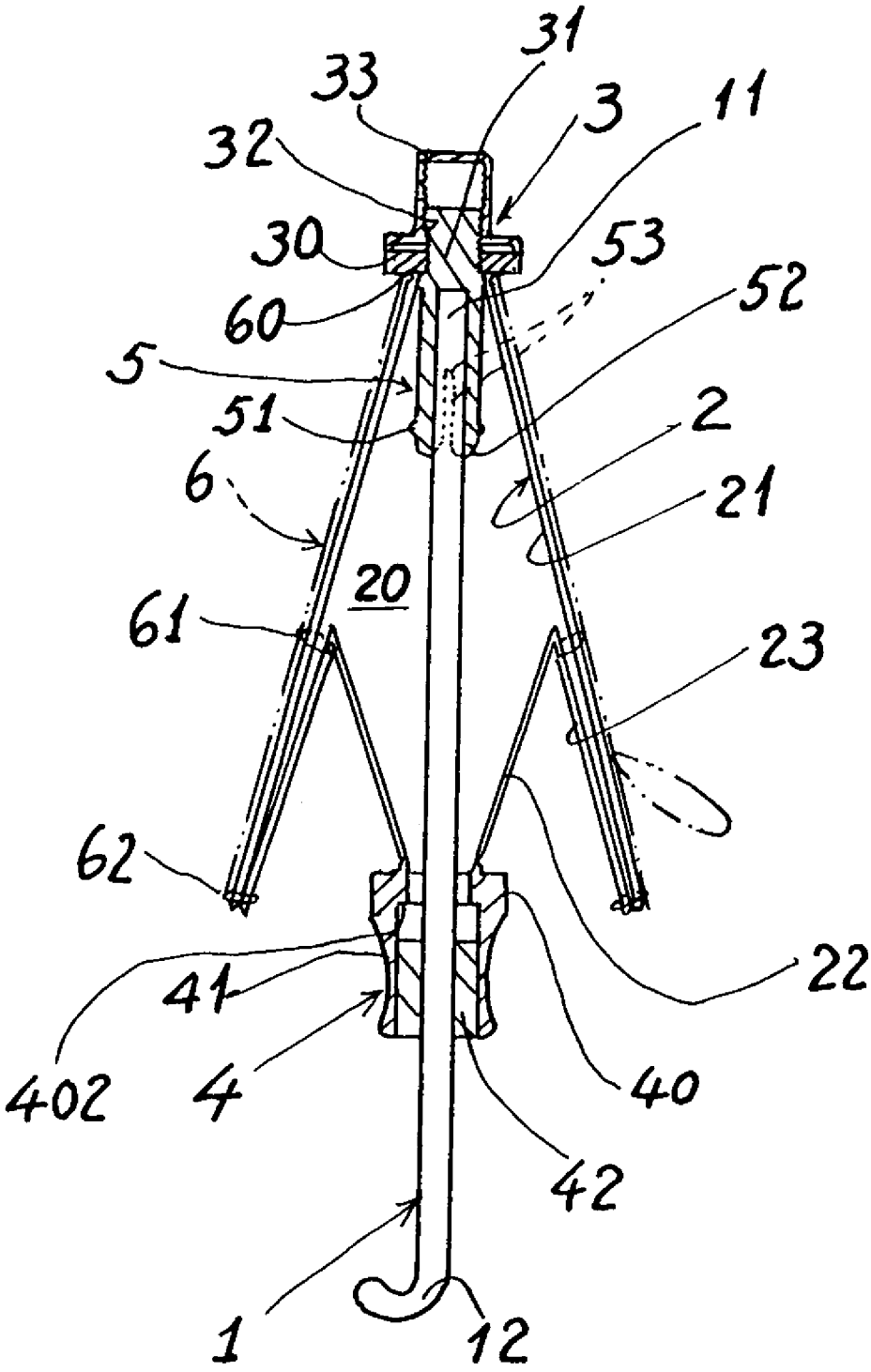
FIG. 5 shows a folded umbrella from FIG. 4.

The catch means 5 is formed on a lower portion of the upper hub 3 and includes: an annular protrusion 51 circumferentially formed on a lower portion of a plurality of branched pawls 52, and operatively engaged with the shoulder portion 402 of the lower runner 4; and a plurality of slits 53 each formed between every two neighboring branched pawls 52, whereby upon raising of the runner 4 for extending the rib assemblies and for the engagement of the annular protrusion 51 with the shoulder portion 402 of the lower runner 4 for opening the umbrella (FIG. 3), the lower runner 4 will be locked on the catch means 5 and on the upper portion of the shaft 1 for stably opening the umbrella; and upon lowering of the lower runner 4 to disengage the shoulder portion 402 of the runner 4 from the annular protrusion 51 of the catch means 5, the runner 4 will then be pulled downwardly for closing or folding the umbrella (FIG. 5).

A sleeve 42 is embedded into the cylindrical hole 411 of the slide member 41 of the lower runner 4 and is slidably engaged with the central shaft 1. By the way, the operation when opening or closing the umbrella will be more smooth since the large hole 411 is now limited by the insertion of said sleeve 42.

Figure 6:
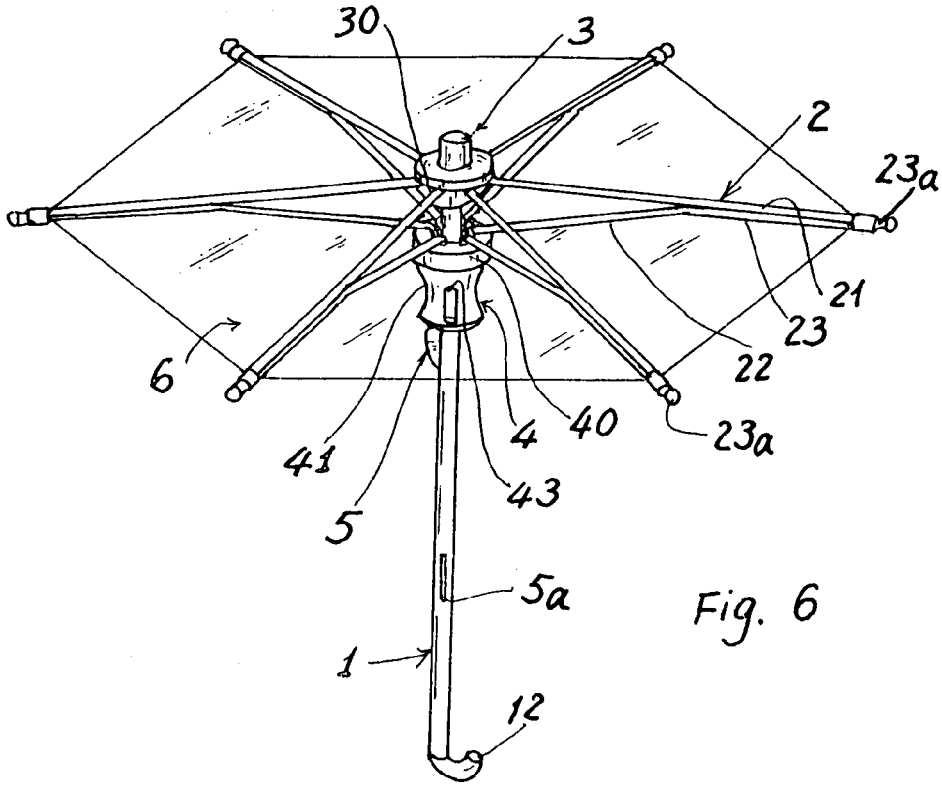
FIG. 6 shows another preferred embodiment of the present invention when opened.
Figure 7:
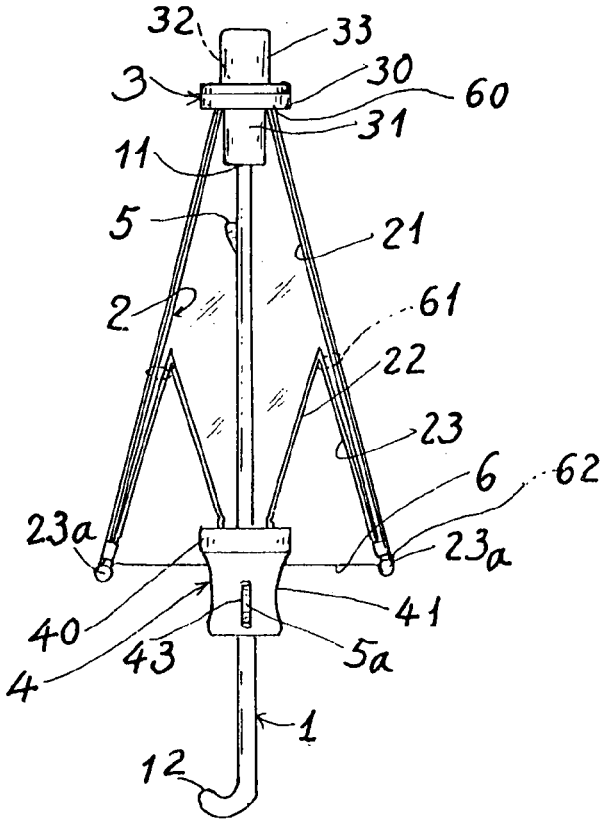
FIG. 7 shows a folded umbrella from FIG. 6.

The catch means 5 may be modified as shown in FIGS. 6 and 7, in which the catch means 5 is resiliently formed in an upper portion of the central shaft 1, whereby upon raising of the runner 4 when opening the umbrella, the runner 4 may be locked on the catch means 5 for stably opening the umbrella.

For closing the umbrella, a lower catch 5*a* is formed in a lower portion of the shaft 1 for engaging a slot 43 formed in the runner 4 when lowering the runner 4 for stably closing the umbrella (FIG. 7).

The rib assembly is outwardly connected with a ball tip 23*a* on an outer living hinge 212 between the top rib 21 and the intermediate rib 23 for securing an outer portion of the umbrella cloth 6.

Figure 8:
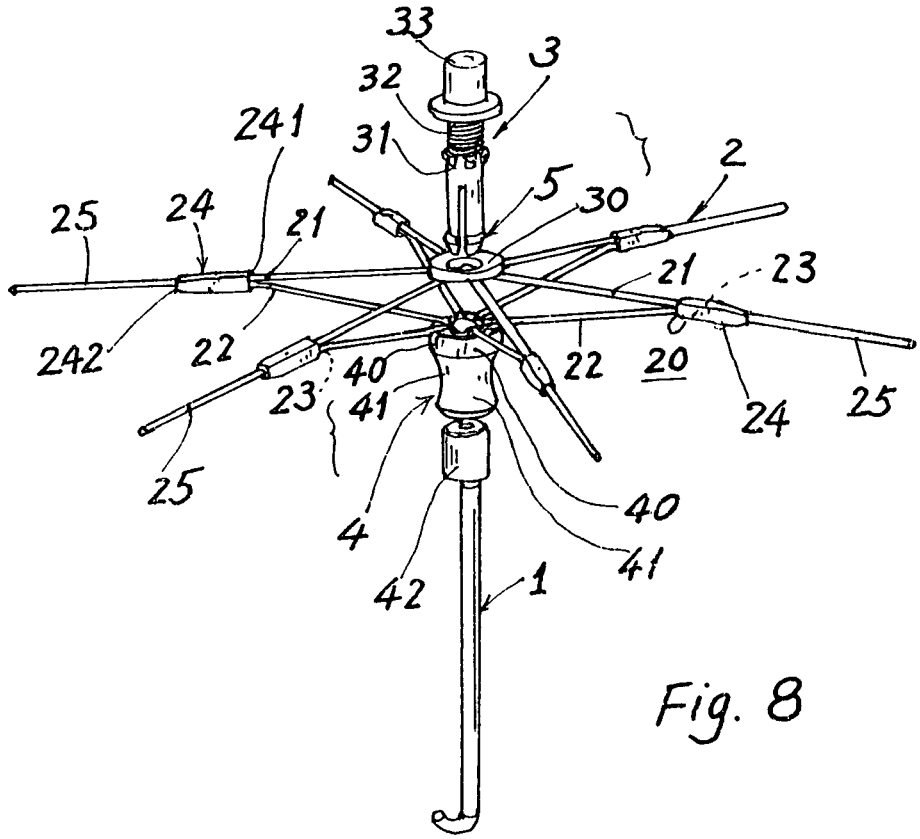
FIG. 8 shows still another preferred embodiment of the present invention.
Figure 9:
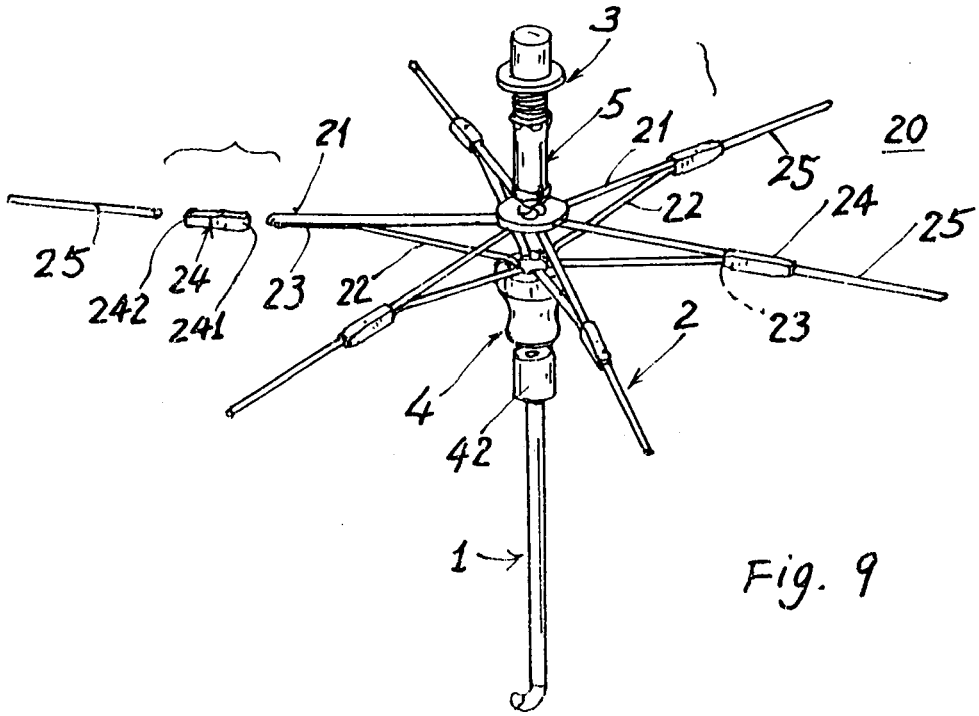
FIG. 9 shows a partially detached rib assembly of the present invention as shown in FIG. 8.
Figure 10:
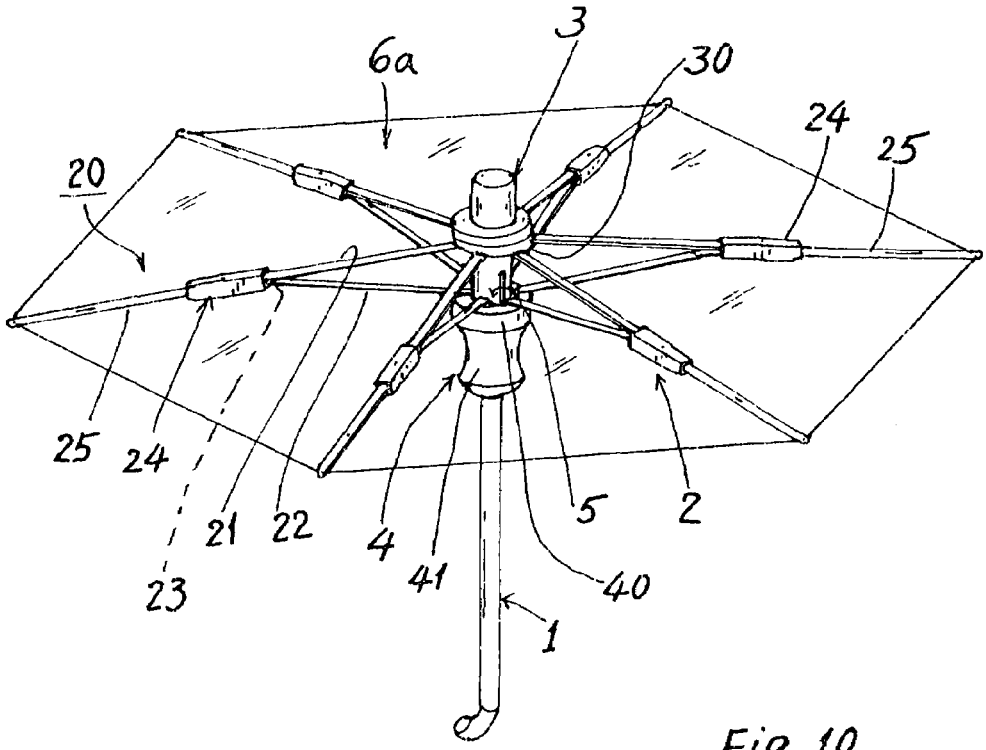
FIG. 10 shows an opened umbrella when assembled with umbrella cloth from FIG. 8.

As shown in FIGS. 8~10, each rib assembly 2 of the one-piece frame 20 is outwardly extended with an outer rib 25 as connected by a joint 24.

The joint 24 includes an inner hole 241 for engaging an outer portion of the top rib 21 and the intermediate rib 23 as juxtapositioned beneath the top rib 21; and an outer hole 242 for engaging the outer rib 25, thereby extending the length of the rib assembly 2 or extending the diameter of the frame 20, adapted for securing a large-diameter umbrella cloth or cover 6*a* (FIG. 10) which is larger than that as aforementioned.

The present invention is superior to the prior art with the following advantages:

1. The frame 20 including the plurality of rib assemblies 2 may be integrally formed by molding process to save the assembly cost and procedures as required in the prior art to assemble each rib assembly to the upper hub and the lower hub (or lower runner).
2. For use, the elements or parts of the present invention may be quickly assembled. Once the umbrella is damaged, it will not be disposed and it can be easily detached for reclaiming the elements of the umbrella, such as by regeneration of the plastic elements, thereby saving materials without wasting them.

Accordingly, the present invention is economically constructed, and also environmentally protective.

The present invention may be modified without departing from the spirit and scope of the present invention.

We claim:

1. An umbrella comprising:

a central shaft having an upper hub formed on a top portion of said central shaft; said upper hub including:

a plug member secured to the top portion of the central shaft, the plug member having a male-threaded portion formed on an upper portion of the plug member, a plurality of projections circumferentially formed bellow the male-threaded portion, and a lower portion extending downward from the projections and having an annular protrusion circumferentially formed thereon; and a cap having a female-threaded portion formed in the cap to be engaged with the male-threaded portion of the plug member and having a flange circumferentially formed on a perimeter of the cap for covering the plug member;

an one-piece frame including a plurality of rib assemblies respectively integrally formed with an upper ferrule secured to said upper hub and integrally formed with a lower ferrule of a lower runner slidably held on said central shaft; said upper ferrule including a central hole for passing the male-threaded portion therethrough and a plurality of recesses formed in an annular bottom portion of the upper ferrule to be engaged with the plurality of projections circumferentially formed on the plug member to secure the upper ferrule on the plug member of the upper hub, whereby upon protruding of the male-threaded portion of the plug member through the central hole of the upper ferrule and upon engagement of the cap on the male-threaded portion, the upper ferrule will be firmly retained on the upper hub and on the top portion of the central shaft, and the flange of the cap covers the upper ferrule, said lower runner including a slide member defining a cylindrical hole in the slide member; said lower runner having a plurality of stretcher ribs formed with said lower ferrule and formed on an upper portion of the slide member, the stretcher ribs integrally connected with the rib assemblies respectively; the lower runner having a lower ferrule hole formed through the lower ferrule and communicated with the cylindrical hole to be slidably movable on the central shaft; and a shoulder portion formed in between the lower ferrule hole and the cylindrical hole to be releasably engaged with the annular protrusion of the plug member to form a catch means for locking the lower runner on an upper portion of the central shaft when opening the umbrella; and said lower runner further including a sleeve embedded into the cylindrical hole of the slide member of the lower runner and is slidably engaged with the central shaft; and an umbrella cloth secured on said one-piece frame.

* * * * *